United States Patent [19]

Crowley

[11] 4,217,094

[45] Aug. 12, 1980

[54] COMBINATION SAFETY AND HEAT CONSERVATION PANEL

[76] Inventor: Helen E. Crowley, 2649 Mountain Rd., Bath, Pa. 18014

[21] Appl. No.: 972,001

[22] Filed: Dec. 21, 1978

[51] Int. Cl.[3] ..... F27D 7/00; F27D 17/00

[52] U.S. Cl. ..... 432/65; 126/202; 165/168; 432/247

[58] Field of Search ..... 432/65, 247; 126/202, 126/93; 165/168

[56] References Cited

U.S. PATENT DOCUMENTS

| | | | |
|---|---|---|---|
| 489,743 | 1/1893 | Hubbard | 432/247 |
| 874,296 | 12/1907 | Brown | 126/202 |
| 2,743,720 | 5/1956 | Dollinger | 126/202 |
| 3,363,889 | 1/1968 | Shirley et al. | 432/247 |
| 3,550,679 | 12/1970 | Benbow et al. | 432/65 |

FOREIGN PATENT DOCUMENTS

| | | | |
|---|---|---|---|
| 426151 | 3/1935 | United Kingdom | 126/202 |
| 539529 | 9/1941 | United Kingdom | 165/168 |

*Primary Examiner*—John J. Camby
*Attorney, Agent, or Firm*—Ruth Moyerman

[57] ABSTRACT

A combination safety and heat conservation panel is disclosed for use with coal or wood heaters or the like. Where the stove flue passes through a wall, the panel is placed between the wall and stove. The panel is hollow, permitting heat radiating from the stove to pass through the panel wall to the panel interior. From the panel interior, the hot air is directed by appropriate means, including fans, baffle and fins, out an end of the panel where it may more freely circulate within the room itself, or whereby, with appropriate connecting pipes, the heat may be directed to other rooms of the house.

By thus absorbing and transferring heat which would otherwise tend to collect in hot spots between the heater and the wall, enhanced safety against fire and heat damage is provided. A further benefit derives from providing better circulation of heat in the room by removing the heat from the unneeded area proximate the heater and the wall and transferring it or allowing it to flow naturally to other parts of the room.

8 Claims, 12 Drawing Figures

FIG. 5
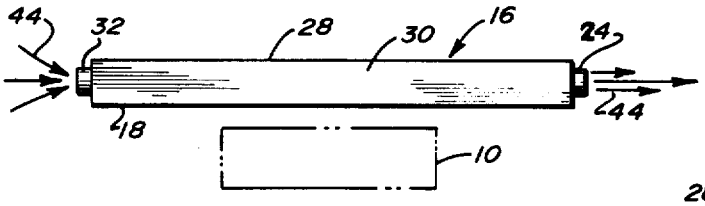
FIG. 6
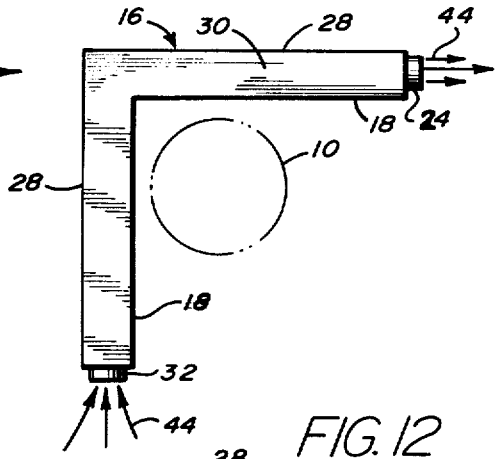
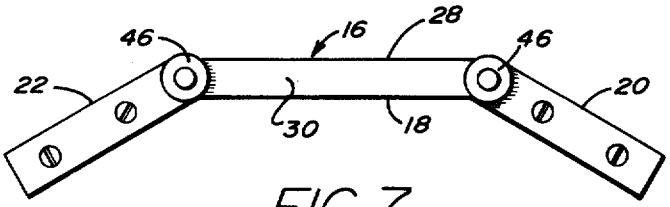
FIG. 7
FIG. 12
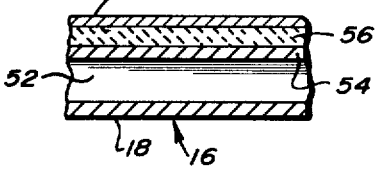
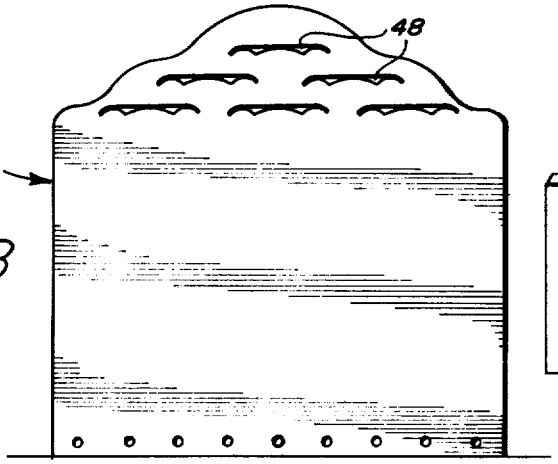
FIG. 8
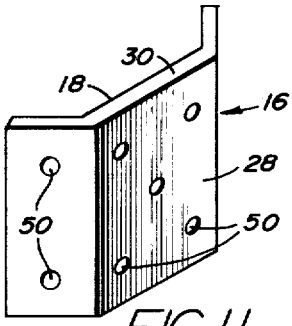
FIG. 11
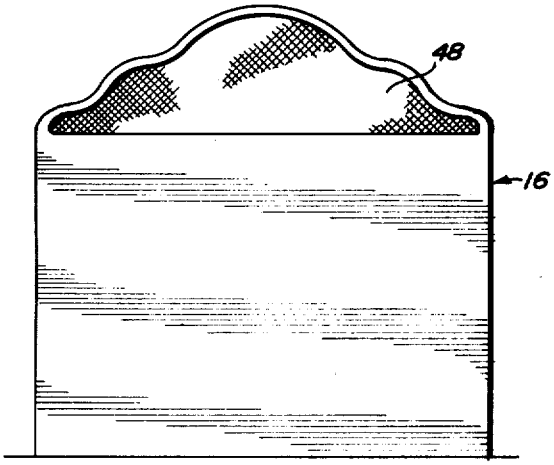
FIG. 9
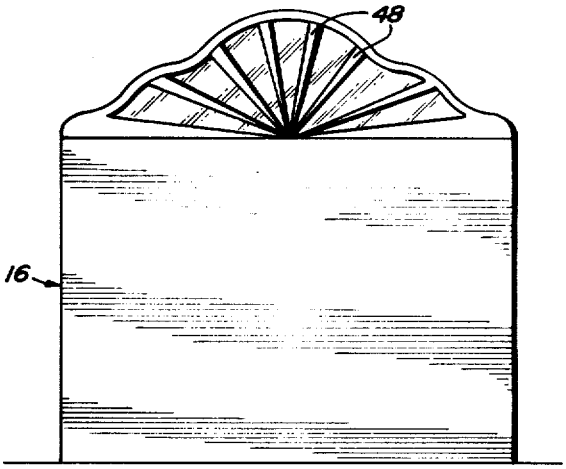
FIG. 10

COMBINATION SAFETY AND HEAT CONSERVATION PANEL

BACKGROUND OF THE INVENTION

1. Field of the Invention

This invention relates to heat exchange and more particularly to heat conducting panels for stoves.

2. Description of the Prior Art

The high cost of fossil fuel today, particularly oil, has lead to a resurgence in interest in room heaters or stoves which are intended to burn wood or coal. The stoves popular today, though sometimes imitating in style and size the stoves of yester-year, are constructed and intended to be used with a much greater concern for heat conservation, efficiency and safety. Thus, catalogs list "potbelly" stoves, cast iron "franklin fireplaces," "parlor " stoves and even ranges intended for cooking food.

Installation of these stoves is much as it always was and necessitates the use of a flue which normally exits into a chimney and the connection is made through the wall of a room. Thus, in order to use the heater or stove, the heater must be placed close to the wall to avoid an inordinately long flue pipe.

In as much as these stoves or heaters commonly generate radiant heat which, by its nature, emanates equally in all directions from the stove, there is a natural tendency for a "hot spot" to develop between the stove and the wall. Such a "hot spot" is normally detrimental to paint or wood such as wall trim which may be in the area of the "hot spot." Some sort of heat shield between heater and wall is desirable.

However, of even greater concern in light of the rising fuel prices today is the need to extract the maximum benefit from the heat values being generated by the heater or stove. Thus, it is highly desirable to be able to move accumulated heat from this area and redistribute it to better advantage somewhere else in the room or house.

Furnace shields are known. U.S. Pat. No. 3,285,593 to Tavernelli et al, for example, discloses a furnace heat shield. However, the heat shield of Tavernelli is intended to shield against heat losses by thermal radiation from a very high temperature furnace. That is, Tavernelli's object is exactly the opposite of the one of this invention. Tavernelli seeks to hold the heat within a certain area proximate the furnace to increase the efficiency of the heating element of the furnace. The present invention's concern is with removing radiant heat from the furnace area and dispensing same throughout the room.

Another device is disclosed by Shantz in U.S. Pat. No. 655,585. Shantz provides a shield for an in-room heater, which heater is exemplary of the old-fashioned kind of heater enjoying this current revival. However, the Shantz shield provides a device to allow air drawn into the room to feed the fire to be provided from an elevated point in the room where the air of "more pure." Thus, the Shantz heat shield has a ventilator on top of a vertically extending pipe which looks a little like a birdhouse, including wind directional arrow. He refers to this part of the device as a ventilating-hood whose gable roof disguises a curved pipe into which fresh air is intended to pass downward between the double walls of the panel and passes from there into the stove. Thus, the air circulation Shantz speaks of is intended to provide the heater with a better source of oxygen as distinguished from the present invention whose purpose is to better circulate heated air produced by the heater.

No heater panel is known which combines both safety features and an improved method for air circulation and there is, therefore, a need for such a panel. To truly achieve the necessary results, such a panel would need to be versatile in order to accommodate a heater positioned midway along a wall or in a corner, or even in the middle of a room. Such a panel would need to be lightweight to enable its storage in the off season and to be practical would require simple construction of inexpensive readily available parts. In as much as the shield would be a part of the fixtures of the room, an attractive facade, especially one combining utilitarian features, would be desirable.

SUMMARY OF THE INVENTION

The aforesaid prior art problems are solved by the combination safety and heat conservation panel of this invention in which a hollow-walled panel is provided. The panel is placed between the heater or stove and the wall serving as the entrance for the flue of the heater. The panel is hollow, with the panel wall closest to the heater being constructed of a material which readily allows heat radiating from the stove to pass through the wall into the panel interior.

The exterior wall of the panel, e.g. the panel wall closest to the wall of the home, is made of a heat insulating material so that heat passing into the panel interior is contained therein.

The panel is also provided with exit means for the heat which may be positioned at any place on the panel which serves the purpose to cause heat to transfer to that part of the room, or house, needing it most. Thus, it is possible to have an exit opening in one end of a panel, particularly in those instances where the panel end is directed toward the center of a room. Another embodiment envisions a panel exit which may be extended by tubing or pipes to allow heat from the panel to be transferred to another room. This latter embodiment is particularly useful where a small bathroom or kitchen is near the room with the heater in it and would benefit from some auxiliary heat which the panel provides. In another alternate embodiment, the panel itself may be provided with decorative facade on, for example, the top of the panel. The decorative facade would contain openings which themselves may be part of the decoration to allow heat to more readily pass from behind the heater upward into the room. These openings may be either of the permanent type or they may be louvered or have other means allowing their selective opening and closing.

Another embodiment of this invention contemplates the use of a fan or blower which would be positioned to force passage of the hot air out of the panel in the direction of the exit openings.

A further embodiment envisions the interior of the panel to contain baffle means, either finned or not, to increase the radiating effect and the even distribution of the heat within the panel.

The panel may be of any shape or size which performs the function, but one that approximates the height of the heater is preferable. The panel itself may be straight, forming a single panel member to be placed behind the heater or the panel may contain sections which bend or form an angle, or several angled sections to better encompass the heater itself. The panel sections may be permanent so that one contiguous angled panel is formed or the panel sections may be hinged to allow more flexibility in their positioning and storage.

It is, therefore, an object of this invention to provide a panel to be used in connection with heaters and stoves to provide better heat distribution and safety features.

It is yet another object of this invention to provide the aforesaid panel to enable the heat provided in a wood, coal or the like heater to be readily and inexpensively transferred throughout the room or house to the point where it is needed.

It is yet another object of this invention to provide a safety and heat conserving panel which is inexpensive to manufacture, versatile in its use and is further easy to assemble and disassemble.

It is still a further object of this invention to achieve all the foregoing objects and to do so by providing a panel that is not only useful but is attractive visually.

These and other objects will be more readily ascertainable to one skilled in the art by reference to the accompanying drawings and exemplary embodiments that follow.

BRIEF DESCRIPTION OF THE DRAWINGS

FIG. 5 illustrates a single section straight panel in top plan view.

FIG. 6 illustrates a double section panel joined at right angles.

FIG. 7 shows a hinged panel.

FIG. 8 illustrates an embodiment with a decorative panel top with warm air exit openings.

FIG. 9 is another variation of a decorative open top panel.

FIG. 10 is yet another variation of a decorative top opening.

FIG. 11 illustrates a back panel outside wall showing alternate air inlet and outlet openings.

FIG. 12 shows an enlarged fragmentary top cross section to illustrate the various components of primarily the panel outer wall.

DESCRIPTION OF THE PREFERRED EMBODIMENT (S)

Figure 1:
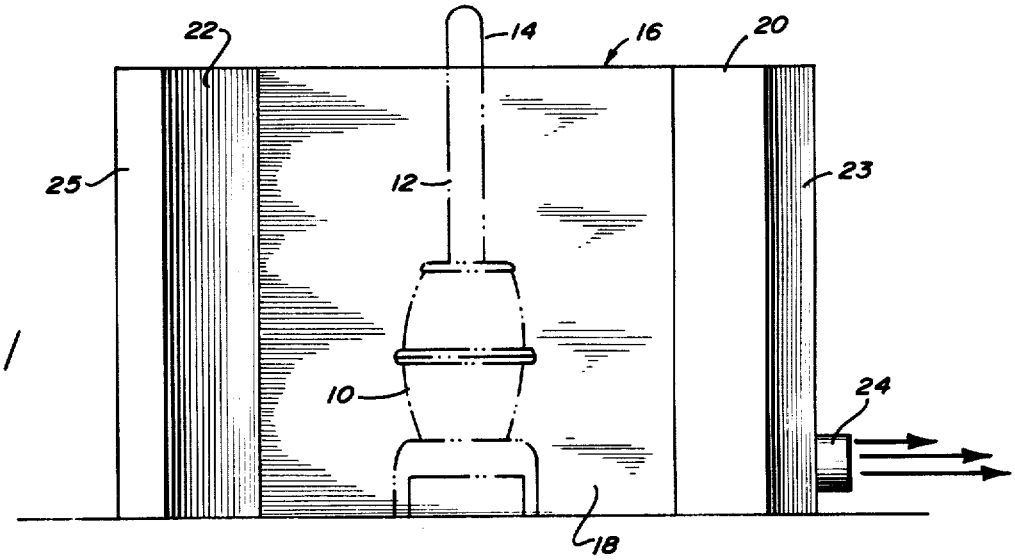
FIG. 1 is a front elevation of a panel of this invention.

Referring now to the drawings, FIG. 1 illustrates a panel of my invention in use with a heater 10 shown in phantom. Heater 10 also includes flue 12, which in this front elevation is shown exiting at point 14 into the wall directly behind the heater. Panel 16, shown in front elevation, includes inner wall 18 which is preferably made of aluminum or iron or other suitable heat permeable materials. Panel 16, in this view, is angled on both ends producing thereby panel sections 20 and 22. Panel ends 23 and 25, in FIG. 1, show the approximate distance between inner wall 18 and the outer wall of the panel not visible in this view. FIG. 1 also includes exit means 24, which in this case is simply a round opening with a short pipe extension. Directional arrows 26 indicate the direction in which the exiting heated air will flow.

Figure 2:
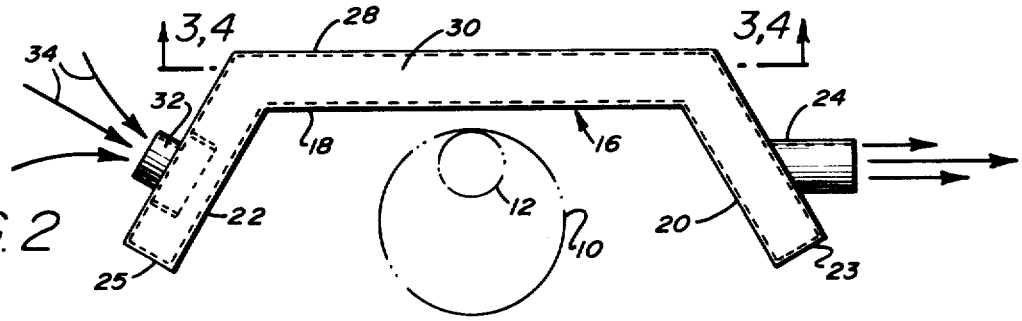
FIG. 2 is a top plan view of the panel of FIG. 1 showing the air where a blower is utilized.

Referring now to FIG. 2, a top plan view of FIG. 1 is shown. In FIG. 2, heater 10, together with its flue 12, are shown partially surrounded by panel 16. In this view, better heat conservation and safety are realized as it may be seen that heater 10 is thus partially surrounded by panel 16. In this view, inner wall 18 is shown and also outer panel wall 28. In contrast to inner wall 18, outer wall 28 is constructed of a heat pervious material and, thereby, serves to retain heat received in the panel within the panel, not allowing its escape to collect in the wall area between the heater and the wall. In this view of panel 16, it may be seen that the panel includes top 30 which sealingly engages each of the two panel walls and, together with the panel ends 23 and 25, form a sealed unit. FIG. 2 also illustrates blower 32 which may be optionally used to increase air velocity and, thereby, heating efficiency of heater 10. Directional arrows 34 indicate incoming air passing through blower 32.

Figure 3:
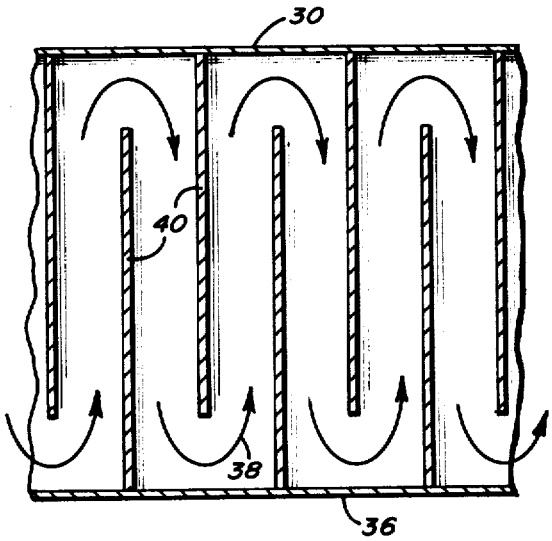
FIG. 3 shows an alternate embodiment of the panel interior where baffle plates are utilized.

Referring now to FIG. 3, an alternate embodiment is shown of the panel interior, taken along section 3—3 of FIG. 2. In FIG. 3, panel top 30, together with panel bottom 36 is shown. In this fragmentary view, air is shown circulating by directional arrows 38 which indicate the sinuous path air would be taking in this view. Air direction is guided by baffles 40. Baffles 40 comprise plates, preferably metal, which are attached alternately to top 30 and bottom 36, thereby forcing the heated air to travel in the desired direction.

Figure 4:
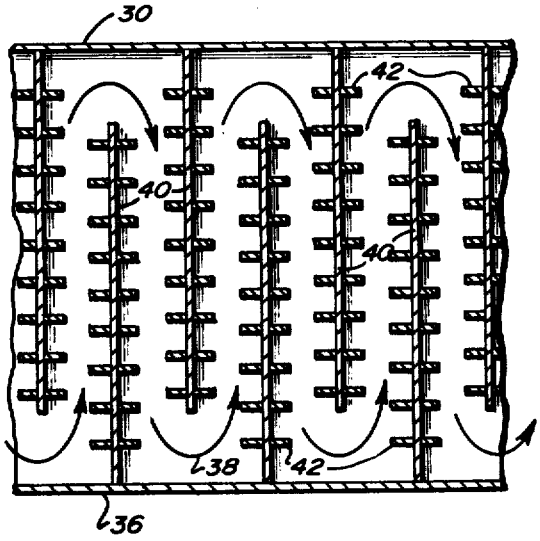
FIG. 4 shows the embodiment of FIG. 3 with the addition of fins on the baffle plates.

Referring now to FIG. 4, an alternate embodiment of FIG. 3 is shown. FIG. 4, also taken on lines 3—3 (4—4) of FIG. 2 shows the baffles 40 including additionally fins 42 projecting at right angles from both sides of baffles 40. Fins 42, also preferably of metal, increase the heat radiation potential of the baffles.

Referring now to FIG. 5, an embodiment is shown in which panel 16 is shown as one, continuous linear section. In FIG. 5, heater 10, shown in phantom, rests in front of panel 16 and panel 16, in this top plan view, shows top 30, inner wall 18 and outer wall 28. Directional arrows 44 indicate air entering through blower 32 and exiting through exit means 14. The embodiment shown in FIG. 5 is especially suitable in a large room with a low ceiling.

Referring now to FIG. 6, a top plan view of an alternate embodiment utilizing a right-angled panel is shown. In FIG. 6, heater 10 is shown as surrounded on two sides by panel 16. Directional arrows 44 again indicate the direction the heated air flows. The embodiment shown in FIG. 6 is particularly suited to an arrangement where the heater would be placed in a corner of a room.

Referring now to FIG. 7, another top plan view is shown in which panel 16 is shown with hinged sections. Hinge 46 is utilized to secure panel section 20 and 22. In this embodiment, the interior could be continuous as shown in the previous Figures or, in the alternative, it is possible to have individual inlets and outlets at each panel section.

Referring now to FIGS. 8, 9 and 10, front elevations of alternate embodiments of the panels are shown. In the embodiment shown in FIGS. 8, 9 and 10, the flat panel top 30 shown in the previous views is replaced by a decorative panel shown in these embodiments as curved. The front of the panel contains openings 48 which, in FIG. 8, are partially scalloped, in FIG. 9 form a latticed grill and in FIG. 10 are shown as wedges. The embodiments shown in FIGS. 8, 9 and 10 are meant to be illustrative only and decorative outlets for the heated air can take many forms and appear at whatever position on the panel is best suited for the heater and the room in which the heater is placed.

FIG. 11 illustrates an embodiment in which the back of panel outer wall 28 is shown provided with "knock-outs" 50. "Knock-outs," as the name implies, are removable circular sections to allow the panel user to insert a blower or a take-off pipe wherever best suits the needs of the room in which the panel is used. Knock-outs 50 are shown in FIG. 11 as being positioned on both the back and side of a panel but it should be appreciated that knock-out provisions may appear anywhere on panel wings of panels as shown in FIGS. 1, 2, 6 and 7 and on both inner wall 18 as well as the panel outer wall 28.

FIG. 12 shows an enlarged fragmentary cross section to illustrate panel construction. In FIG. 12, inner wall 18 is shown as a relatively thin sheet, preferably aluminum. Panel interior 52 is the air chamber. Panel outer wall 28 is shown composed of several layers: first an aluminum foil layer 54, next an asbestos liner 56 and, finally, the last layer, metal outer wall layer 58.

There are many variations which may be practiced within the scope of this invention.

It should be noted that certain embodiments, such as FIGS. 1, 2, 5 and 6, are shown adapted for use with blowers and are thus shown with blower inlets on the lower side of a panel edge and an outlet on the upper side of an opposing panel edge. These embodiments could be utilized without blowers and heated air circulation enhanced by providing a plurality of openings in the panel front such as those shown in FIGS. 8, 9 and 10.

Likewise, the embodiments of FIGS. 8, 9 and 10 could be provided with blowers instead of the front panel inlet air openings.

All panels may be provided with legs which is especially advantageous where the panel is to be used on a carpeted floor.

Generally, to maximize the utility, the panel height should be at least about six (6) inches above the height of the stove or heater.

The inner wall, as has been mentioned, may be made of aluminum or other light metal or even cast iron. Non-metals also may be used so long as the panel wall conducts heat. By contrast, the back panel wall must be insulating such as asbestos to retain the heat and protect the walls of the room.

Another variation contemplated within the scope of this invention employs the use of water. In this embodiment water pipes could be placed in the air chamber and heat entering the panel would heat the water which would then be piped out of the panel by a circulator to a radiator.

My invention also contemplates the use of a thermostat in conjunction with the fan or blower so that the blower would operate only as needed.

Having described and illustrated my invention, it is not intended that such description limit this invention, but rather that this invention be limited only by a reasonable interpretation of the appended claims.

What is claimed is:

1. A free-standing and portable, self-supporting safety and heat conservation panel intended for interposition between a fossil fuel burning space heating device and a wall comprising:

(a) a plurality of continuous parallelpipedal, free standing panel sections joined in angular relationship to each other and partially encircling, but separate, exterior, and spaced apart from, a room space heating device, said sections forming a single portable panel having an inner wall proximate said heating device, a spaced-apart outer wall remote from said heating device, a top spanning the two walls, a bottom and ends, thereby closing the space between said walls to define a single, contiguous hollow interior therebetween, said inner wall being constructed of a heat conducting material and said outer wall being constructed of an insulating material;

(b) inlet means to permit air at ambient temperature to enter said hollow interior;

(c) guide means for permitting heated air entering said panel to be conducted through said panel interior; and, (d) exit means, remote from said inlet means, directionally oriented to permit heated air to leave said hollow interior in a predetermined direction to heat areas distant from said panel and heater.

2. The panel according to claim 1 wherein said guide means of part (c) includes baffle plates mounted alternately on said panel top and panel bottom, said plates extending longitudinally within substantially said entire panel height whereby heated air entering said panel is sinuously directed through said panel.

3. The panel according to claim 2 wherein each of said baffle plates include a plurality of fins extending at right angles from said plates whereby more heat-radiating potential is provided within said panel.

4. The panel according to claim 1 wherein there are three panel sections.

5. The panel according to claim 1 wherein there are two panel sections.

6. The panel according to claims 1, 4 or 5 wherein said panel includes hinging means to allow said panel to be formed into variable angled sections.

7. The panel according to claim 1 wherein said panel includes blower means to help expel heated air collecting within said heater panel.

8. The panel according to claim 1 wherein said panel top comprises an upwardly extending decorative portion, said portion containing openings therein to allow heated air within the panel to escape into the room.

* * * * *